US009280885B2

(12) United States Patent
Frederick

(10) Patent No.: US 9,280,885 B2
(45) Date of Patent: Mar. 8, 2016

(54) INTEGRATED ALARM DEVICE

(71) Applicant: STRATA PROXIMITY SYSTEMS, LLC, Sandy Springs, GA (US)

(72) Inventor: Larry D. Frederick, Hunstville, AL (US)

(73) Assignee: Strata Safety Products, LLC, Sandy Springs, GA (US)

( * ) Notice: Subject to any disclaimer, the term of this patent is extended or adjusted under 35 U.S.C. 154(b) by 169 days.

(21) Appl. No.: 14/024,661

(22) Filed: Sep. 12, 2013

(65) Prior Publication Data

US 2014/0077961 A1 Mar. 20, 2014

Related U.S. Application Data

(60) Provisional application No. 61/700,055, filed on Sep. 12, 2012.

(51) Int. Cl.

| | |
|---|---|
| ***G08B 21/00*** | (2006.01) |
| ***G08B 21/02*** | (2006.01) |
| ***G08B 13/14*** | (2006.01) |
| ***G08B 13/26*** | (2006.01) |

(52) U.S. Cl.

CPC ..... *G08B 21/02* (2013.01); *G08B 13/1427* (2013.01); *G08B 13/26* (2013.01)

(58) Field of Classification Search

None

See application file for complete search history.

(56) References Cited

U.S. PATENT DOCUMENTS

| | | | | |
|---|---|---|---|---|
| 3,594,490 | A | 7/1971 | Mitchell et al. | |
| 5,939,986 | A * | 8/1999 | Schiffbauer et al. | 340/573.1 |
| 7,371,977 | B1 | 5/2008 | Preonas | |
| 7,974,582 | B2 | 7/2011 | Zhu et al. | |
| 8,232,888 | B2 * | 7/2012 | Frederick et al. | 340/686.1 |
| 8,710,979 | B2 * | 4/2014 | Frederick | 340/539.11 |
| 2001/0051298 | A1 | 12/2001 | Hanafusa et al. | |
| 2006/0087443 | A1 * | 4/2006 | Frederick et al. | 340/686.6 |
| 2009/0109049 | A1 | 4/2009 | Frederick et al. | |
| 2009/0266887 | A1 * | 10/2009 | Molyneaux et al. | 235/382 |
| 2009/0267787 | A1 * | 10/2009 | Pryor et al. | 340/686.6 |
| 2009/0322512 | A1 * | 12/2009 | Frederick | 340/539.11 |
| 2010/0271214 | A1 * | 10/2010 | Frederick | 340/600 |
| 2011/0050444 | A1 * | 3/2011 | Stull | 340/686.6 |
| 2011/0227748 | A1 * | 9/2011 | Schaible et al. | 340/686.6 |
| 2012/0268261 | A1 * | 10/2012 | Frederick et al. | 340/435 |
| 2013/0033258 | A1 * | 2/2013 | Parr et al. | 324/207.22 |
| 2013/0038320 | A1 * | 2/2013 | Frederick | 324/207.13 |
| 2014/0077961 | A1 * | 3/2014 | Frederick | 340/686.6 |
| 2014/0232537 | A1 * | 8/2014 | Delprat et al. | 340/435 |
| 2014/0361903 | A1 * | 12/2014 | Sawada | 340/686.6 |
| 2014/0375445 | A1 * | 12/2014 | Frederick et al. | 340/435 |

FOREIGN PATENT DOCUMENTS

| | | |
|---|---|---|
| EP | 0 431 343 A2 | 6/1991 |

OTHER PUBLICATIONS

ThomasNet, More about EMI/RFI Shielding, Mar. 12, 2011, http://www.thomasnet.com/about/emi-rfi-shielding-74850207.html.

* cited by examiner

*Primary Examiner* — Julie Lieu

(74) *Attorney, Agent, or Firm* — Dickstein Shapiro LLP

(57) ABSTRACT

An integrated alarm device for a proximity detection system that is based on use of low frequency magnetic fields, to avoid conflicts in crowded work sites. A proximity detection system includes a magnetic field generator, and a personal alarm device. The personal alarm device includes an antenna configured to detect a magnetic field, a controller electrically coupled to the antenna, and a warning device electrically coupled to the controller. The warning device includes a sounder device and a shield, and the shield is adapted to attenuate EMI emitted from the sounder from reaching the antenna and/or from inducing current in electrical components in the personal alarm device.

32 Claims, 7 Drawing Sheets

INTEGRATED ALARM DEVICE

CROSS-REFERENCE TO RELATED APPLICATIONS

This application claims priority under 35 U.S.C. §119(e) to provisional U.S. patent application Ser. No. 61/700,055 filed on Sep. 12, 2012, the entirety of which is incorporated by reference herein.

BACKGROUND

This disclosure relates generally to proximity detection systems at work sites, and in particular to personal alarm devices (PADs) for use with an interactive magnetic marker field and proximity detection system.

Mining is a very diverse industry, in many ways. The diversities include the differing products being mined, geologic formations from which the product is being extracted, locations throughout the world, strategies for mining, countless types of equipment used, mining above ground and underground, to mention a few examples. In most cases, equipment is being used to accomplish or to assist in the mining process, including mining machines and vehicles. Such vehicles and mobile equipment may be used for above and/or below ground operations. Examples of the equipment include: road construction equipment such as trucks, road graders, rollers and pavers; surface mining equipment, such as for use with gravel and sand operations, front end loaders, trucks, dozers, conveyors and other items; underground mining equipment such as continuous miners, shuttle cars, conveyors, crushers, load-haul-dump vehicles, man-trips, tractors, and other items. The equipment also includes fork lifts, cranes, and trucks used at warehouses and shipping ports.

Much too often, workers are injured while doing their jobs. As more equipment is used and as that equipment has become larger and more powerful, and as the operations have become more complex, many of the injuries and fatalities result from workers being struck or crushed by the mining machines or by collisions between vehicles.

Many methods have been devised to warn people against being struck, pinched, crushed or otherwise harmed by vehicles and mobile equipment. Unfortunately, the systems that have been devised to help protect people and property in these industrial operations, such as proximity detection and collision avoidance systems, have usually not been very effective. A new proximity detection system was developed and successfully demonstrated for use on continuous miners, as disclosed in U.S. Pat. No. 7,420,471 (the '471 patent), U.S. Pat. No. 8,169,335 (the '335 patent), U.S. Pat. No. 8,232,888 (the '888 patent) and U.S. Pat. No. 8,446,277 (the '277 patent), and US patent publications 2009/0322512 (the '512 publication) and 2012/0268261 (the '261 publication), which patents and publications are herein referred to collectively as the "Frederick patents," the disclosures of which are incorporated herein by reference in their entireties.

An objective of the '471 patent is to help prevent the crushing or pinning of personnel who are remotely controlling a continuous miner, and to help protect other personnel assisting in use of the continuous miners. The '471 patent also envisions to provide protection to personnel from other types of mobile equipment and machines. The system of the '471 patent employs a magnetic marker field and an active architecture that incorporates two-way communication between the worker and the machine that the worker is near. Warnings are given to workers who are too close to the miner. Warnings are also provided to the operator of the machine. Provisions are made to immobilize the equipment until personnel are able to reach a safer position.

The magnetic fields used in the '471 patent system oscillate at low frequencies and can be effectively used to mark off warning zones, danger zones and silent zones. Although the maximum practical range of such low frequency magnetic fields may be as much as one hundred feet, in most applications that is more than is needed or desirable for most equipment. Typical very large off-highway haul trucks would probably be best served with a warning zone in the range of eighty feet and a danger zone in the range of thirty to forty feet. In some applications, such as remotely controlled continuous miners, it is necessary for the operator to remain within a range of five to ten feet of the miner much of the time in order to maintain good visual contact with the machine and the immediate surroundings. The zones are shaped to be longer in the direction of travel or movement, but shorter in directions perpendicular to the direction of travel. In underground mines, the low frequency magnetic fields pass unimpeded through earth formations so that a worker that is around a corner, not in line of sight, or otherwise obstructed, will still be visible to the marker field. These magnetic fields do not radiate from antennas but simply expand and contract around the element that produces them, and are well suited for marking boundaries between silent zones and warning zones.

The embodiments of the invention are particularly applicable to work sites that require personnel to be in close proximity to various hazardous elements, such as machines, mobile equipment, remotely controlled machines, and operated vehicles. Such work environments may include locations that are inherently dangerous and should be avoided or entered only with great caution. Examples of such work environments include surface mining, underground mining, sand and gravel operations, road construction, warehouses, shipping docks, coke plants, etc. Hundreds of people are killed each year in the U.S. in such work environments. Workers are sometimes struck, pinched, crushed or otherwise harmed while performing their jobs in such environments. Collisions between the various elements at the work sites need to be avoided also to avert property damage.

Referring now to FIG. 1, there is illustrated a simplified example of a work site in which a proximity detection system is implemented. FIG. 1 shows a truck 304 on which a magnetic field generator 81 is mounted. The magnetic field generator 81 generates a magnetic field 92 that surrounds the truck 304. The edge of the magnetic field 92 generated by the magnetic field generator 81 corresponds to the border of a Warning or Danger Zone surrounding the truck 304. A worker 301 within the boundary of the Warning or Danger Zone is in potential danger from being struck or otherwise injured by the truck 304. The worker 301 carries a personal alarm device 60. If the worker 301 and, correspondingly, the personal alarm device 60 are within the magnetic field 92 created by the magnetic field generator 81, the personal alarm device 60 detects the presence of the magnetic field 92 and issues a visual or audio warning. In embodiments of the magnetic field warning system, as detailed in the '888 patent, multiple magnetic field generators 81 may be used to generate Warning and Danger Zones having a complex shape around the truck 304 or other equipment or areas. These zones may be adjusted in both size and shape. In addition, safe zones may be designated near the truck 304 in which a personal alarm device 60, while within the magnetic field 92, does not generate a warning signal to the worker 301.

FIG. 2 is a diagram of the personal alarm device 60 and the magnetic field generator 81 of the proximity detection system of FIG. 1. The magnetic field generator 81 is contained within a housing 80 and includes an amplifier 84 connected to a ferrite core 90, inductor 86 and capacitor 88. In addition, the magnetic field generator 81 is connected to a power source 83 that provides the power to operate the magnetic field generator 81. The amplifier 84 is connected to and controlled by a controller 82. The ferrite core 90, inductor 86 and capacitor 88 generate a magnetic field 92 in response to an input voltage from the amplifier 84. The amplifier 84 is controlled by the controller 82 which controls the voltage and current outputs of the amplifier 84. The controller 82 is also connected to a receiver 96 and warning system 98. The receiver 96 is connected to an antenna 94 which receives an input signal 76 from a personal alarm device 60. The antenna 94 conveys the signal 76 to the receiver 96 which passes the signal 76 to the controller 82. Upon receiving the signal 76 from the personal alarm device 60, the controller 82 directs the warning system 98 to issue a warning. In one embodiment, the warning system 98 may issue an audio and/or visual warning. In another embodiment, the warning system 98 may be capable of terminating the operation of a vehicle to which the warning system 98 is mounted, for example, the truck 304 of FIG. 1. The magnetic field generator 80 may also be mounted in a location in which it is desirable to warn a worker carrying a personal alarm device 60 of their proximity to the location.

The personal alarm device 60 has x, y, and z axis magnetic field antennas 62 that sense the magnetic field 92 produced by the magnetic field generator 81. The sensed magnetic field signal 92 is passed through filters 66 and an amplifier 68 to a signal detector 64. The signal detector 64 then passes information about the detected signal to a controller 70. The controller 70 activates a transmitter 72 which transmits a corresponding response signal 76 to the magnetic field 92 through an RF (radio frequency) antenna 74. In one embodiment, the response signal 76 is an RF signal. The personal alarm device 60 is powered by power source 71. The personal alarm device 60 is carried by the worker 301 (FIG. 1) in order to provide the worker with a warning of their proximity to a magnetic field generator 81.

Proximity detection systems are beginning to be deployed in many types of mining operations around the world in an effort to avert mining accidents related to the use of machines and vehicles. As this technology advances, there is an increased need for higher performance from these systems.

The components of a PAD may include an antenna for detecting the marker field, a signal generator, visual and auditory alarms, and associated batteries, electronics, firmware, software, wiring, housing and mounting structure, and/or other components including those described in the Frederick patents.

Piezoelectric sounders have been used as part of the PADs to generate an audible alarm because such sounders use little power when producing a sufficiently loud sound, and because they are small in size. However, such piezoelectric sounders have a characteristic that causes a problem when used with a low frequency magnetic field system. These type sounders emit electromagnetic interference (EMI) in the low frequency spectrum which introduces noise into the sensing coils.

In work environments where hard hats are being used, it is effective to place the warning devices on the hard hat so that an alarm can be seen within the peripheral vision of the worker (i.e., in the line of sight) and/or so that the audible alarm is near their ear so that it can be heard even in noisy environments. See the '512 publication for a description of a hard hat positioned PAD. When used on a hard hat, the warning device portion of the PAD can be physically separated from the sensor portion by a sufficient distance to prevent the EMI from degrading proper operation. This is typically accomplished by positioning the sensor portion on the back of the hard hat and positioning the warning portion near the front of the hard hat, e.g., on the brim. If a hard had is not being used, then this separation must be accomplished by other means. Cables have been used which allow for the warning device portion to be in a shirt pocket, where it can be seen and heard, while the sensor portion is on a belt.

Also, placement of the device on the hard hat ensures that the device will always be present as part of the hard hat, a mandatory requirement in many industrial operations, and not left behind or lost. Workers who are busy with the many things required for their jobs do not like to have to keep up with safety devices. Mounting PAD components on the hard hat eliminates a nuisance for the worker and results in better acceptance and compliance. However, although many industrial operations require wearing a hard hat, many others do not. Therefore, another approach is required.

Multiple pockets on a vest have also been tried for holding various components of a PAD, with the piezoelectric sounder component (warning device portion) pocket being positioned a sufficient distance from the antenna component (sensor portion) pocket. However, acceptance of the PAD by the user will be improved if the sounder and antenna can be included in a single, integrated PAD unit. To use this approach, the piezoelectric sounder emitted EMI noise inducement problem must be solved.

The manner in which workers are given alerts or warnings is important. Alarms given to the worker should be implemented so as to ensure that they will not be missed or ignored but must also not be a nuisance to the person who is using them. There is a need for improvement of the available alarm devices, so that they effectively satisfy these two requirements as well as being practical to use.

SUMMARY

In one embodiment described herein, a personal alarm device includes an antenna, a piezoelectric sounder, and a shield, the shield positioned to attenuate EMI emitted from the sounder from reaching the antenna.

In another embodiment described herein, a personal alarm device includes an antenna, a piezoelectric sounder, and a shield, the shield positioned to attenuate EMI emitted from the sounder from inducing current in electrical components in the personal alarm device.

In another embodiment described herein, a proximity detection system includes a magnetic field generator, and a personal alarm device. The personal alarm device includes an antenna configured to detect a magnetic field, a controller electrically coupled to the antenna, and a warning device electrically coupled to the controller. The warning device includes a piezoelectric sounder device and a shield, the shield adapted to attenuate EMI emitted from the sounder from reaching the antenna and from inducing current in electrical components in the personal alarm device.

The above and other advantages and features of the embodiments described herein will be more clearly understood from the following detailed description which is provided in connection with the accompanying drawings.

DETAILED DESCRIPTION OF PREFERRED EMBODIMENTS

The various embodiments described herein are particularly applicable to work sites that require personnel to be in close proximity to various hazardous elements, such as machines, mobile equipment, remotely controlled machines, and operated vehicles. Such work environments may include locations that are inherently dangerous and should be avoided or entered only with great caution. Examples of such work environments include surface mining, underground mining, sand and gravel operations, road construction, warehouses, shipping docks, coke plants, etc. Workers are sometimes struck, pinched, crushed or otherwise harmed while performing their jobs in such environments. Collisions between the various elements at the work sites also need to be avoided to avert property damage.

Proximity protection systems are normally configured specifically for the type of machine or vehicle on which they are installed. For example, a typical shuttle car used in an underground coal mine will generally require a four generator ping-echo type system, utilizing two pairs of generators, each pair configured to produce shaped fields, in the form of a pulse (the "ping") of an oscillating magnetic field. The primary information from personal alarm devices ("PADs") or vehicle alarm devices ("VADs") to the system will be a short pulse of radio frequency ("RF") (the "echo"). In this configuration, explained in detail in the '888 patent, any number of PADs and VADs can be present with no conflict between them. The magnetic fields are pulsed, having a statistical timing element such that multiple systems can be operative within a typical work space without conflicts that would impair the effectiveness of the system.

Figure 1:
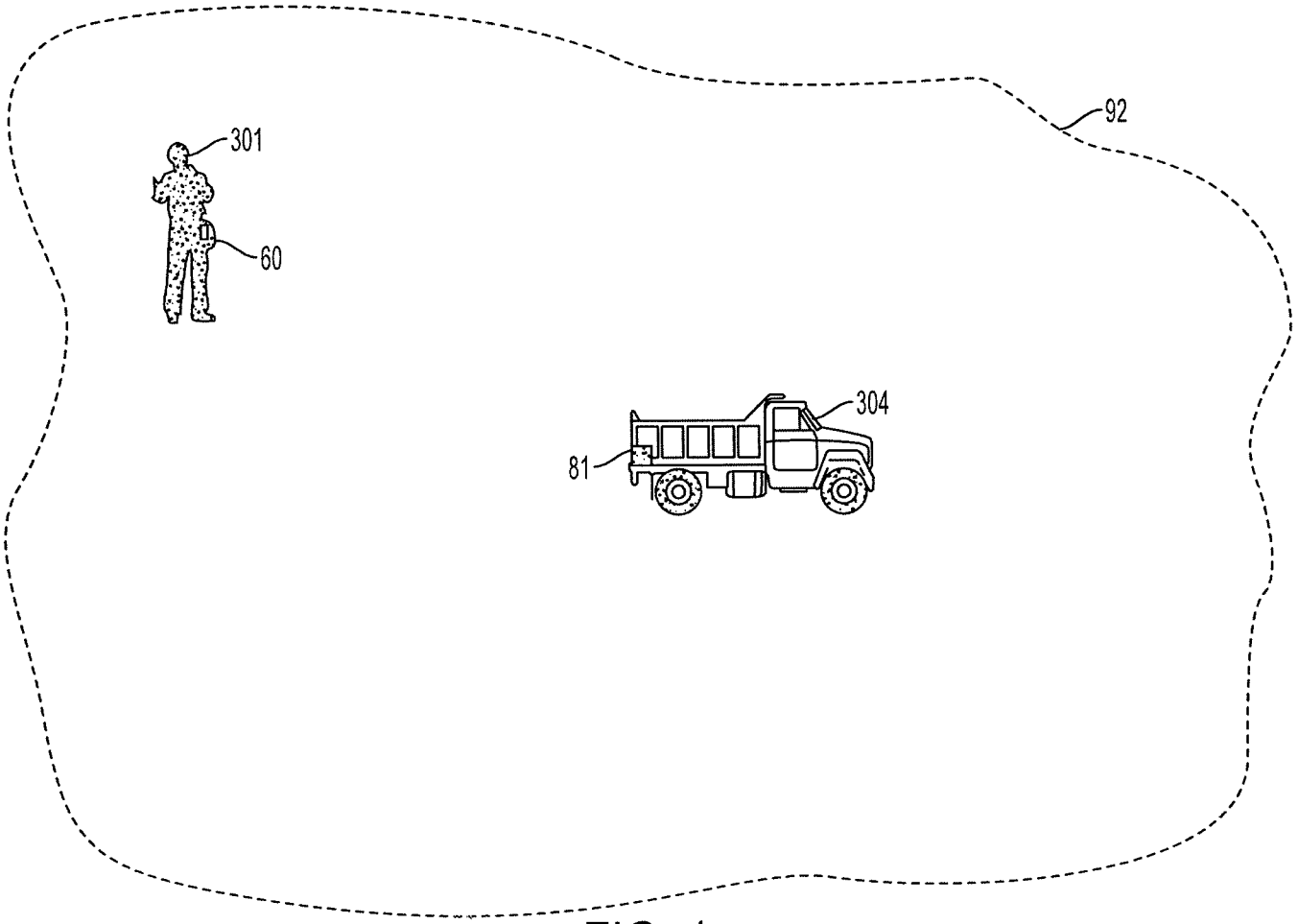
FIG. 1 PRIOR ART
FIG. 1 is a diagram of an exemplary work site at which a proximity detection system is implemented.
Figure 2:
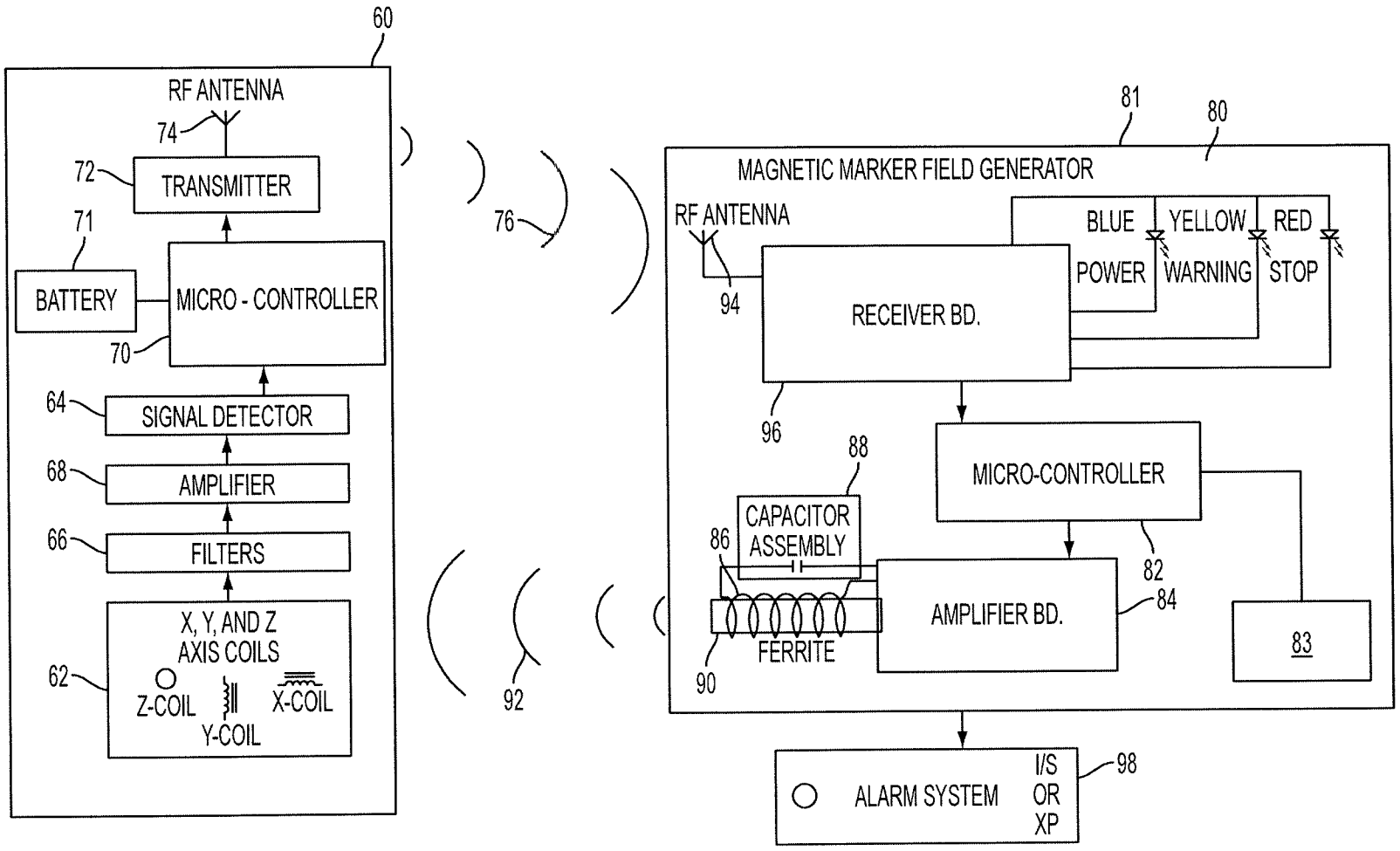
FIG. 2 PRIOR ART
FIG. 2 is a diagram of a personal alarm device and magnetic field generator of the proximity detection system of FIG. 1.
Figure 3:
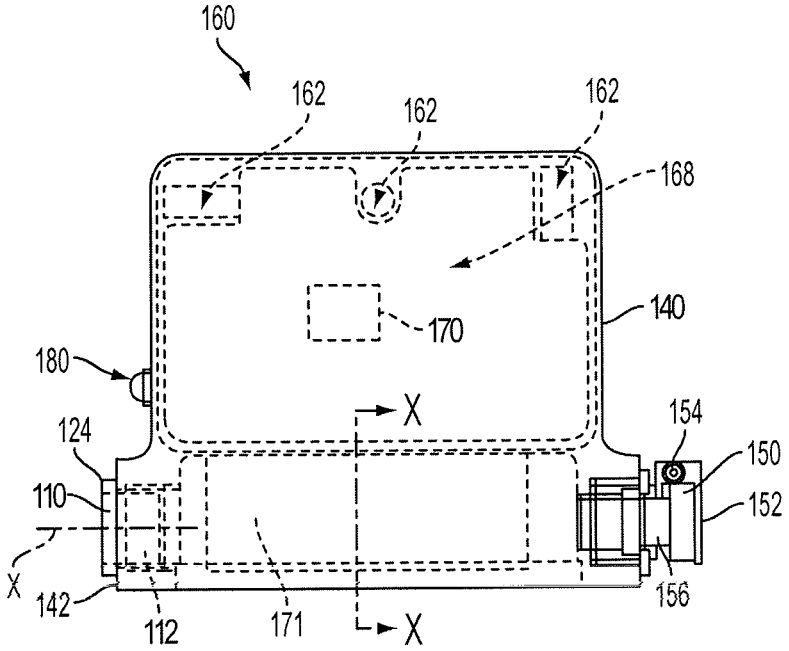
FIG. 3 is a side view of an integrated alarm device according to preferred embodiments.
Figure 4:
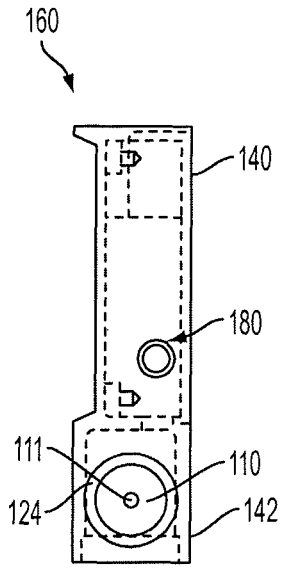
FIG. 4 is an end view of the integrated alarm device of FIG. 3.
Figure 5:
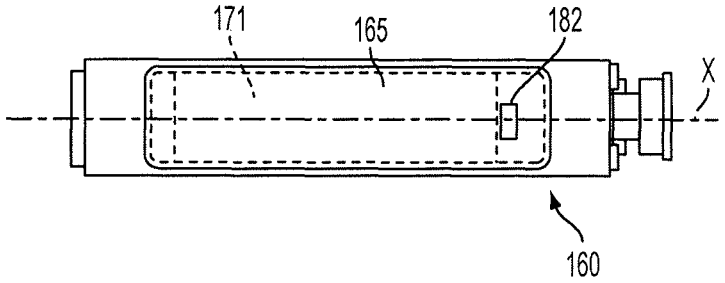
FIG. 5 is an bottom view of the integrated alarm device of FIG. 3.

Referring now to FIG. 3, a personal alarm device 160 according to preferred embodiments is illustrated. The PAD 160 is a single unit that is equipped with all the required performance capabilities while still being small enough to fit into a shirt pocket or in a pouch provided on a safety vest. Included in the device 160 is a means of detecting and measuring the magnetic field produced by the magnetic field generator of the proximity detection system, and of making decisions about the proximity of the moving machinery or vehicles and for issuing signals to alert the worker and for issuing signals to the operator of the machine and/or to slow or stop the machine.

Both visual and audible signals are include that may be synchronized in order to maximize the stimulation to the worker. An LED 180 provides a visual warning and a sounder 112 provides an audible warning. A lighted vest, with LEDs, electro-luminescent wire or other lighting elements, could also provide visual warning to the worker and/or others. Such synchronous stimuli tend to reduce the chance of missing an alarm due to other persons or sounds or activities in the area. Microcontrollers measure the incoming magnetic field pulses and make many logical decisions as to the responses to make to the magnetic field generators and for alerting the worker who is carrying the PAD 160. Communications between the PADs and the magnetic field generators are essential to the process of determining if a worker is too close to a machine and for deciding what action should be taken by the worker and/or the operator of the machine. Communications from the PAD back to the magnetic field generator is accomplished with a UHF transmitter. A rechargeable battery 171 provides power and a special port 150 provides a means to recharge the battery 171. The port 150 includes a jack 156 for accepting a charging cable (not shown), and a cover 152 is connected to the jack 156 through a hinge 154. The cover 152 prevents dust from entering the jack 156, and also may serve as a shield to inhibit EMI from escaping the jack 156. The PAD 160 may be disabled during charging so it will not be induced to generate a false alarm by EMI emitted from the charging equipment. An optional switch 182 provides a means to remove power (e.g., to turn off the device) in order to save battery power. The LED 180 may be caused to blink every few seconds, typically every 10-20 seconds, to assure the worker that the battery 171 is adequately charged. This is done without making a sound with the sounder 112 in order to not be a nuisance.

Clearly, much electronics is required to accomplish all the required tasks and good design procedures are required to ensure that the electronics are effective and accurate, and that the electronics do not cause interference to other elements and are not easily interfered with by other elements. However, even with proper design practices being followed, the EMI problem previously described must be solved. A key part of the solution is the use of a special shield, e.g., shield cup 120, made specifically for the sounder 112.

Provisions must be made to make it easy for the worker to carry the PAD, make it convenient to charge the PAD, and provide a practical means of carrying the PAD even when heavy clothing must be worn in cold weather or when working around furnaces or other hot equipment. For these special cases, a safety vest may be used that has a special pocket positioned where it is easy for the worker to see the visual alarm indication and to hear the audible alarm. The pocket may include a first flap to secure the PAD unit within the pocket so that it will not fall out during use. The pocket may include a second small flap to allow quick and easy access for attaching a charging cable. This way, when the worker puts on his vest before entering the work area, his PAD will already be in his vest. All he has to do is to disconnect the cable that is connected to the charger, close the flap and proceed to work.

An essential task to be performed by a PAD is to detect and measure the strength of low frequency magnetic fields that are produced by a magnetic field generator. By making measurements of this magnetic field, the PAD can determine when it is within the boundary of a a warning zone or a danger zone. As mentioned earlier, the preferred device for providing an audible sound is a piezo-electric sounder device, which are known to generate EMI in various frequency ranges, including within the low frequency range used to produce the magnetic marker field. Therefore, if the sounder is too close to the sensing coils of the PAD, when the sounder is required to make a sound, it can alter the magnitude and characteristics of the magnetic pulses being measured which results in errors, a problem that cannot be tolerated. It should be understood that the typical gain applied to the signal from the sensing coils, which are wound on small ferrite rods, will typically be in the range of 3000 (i.e., output is three thousand times input) and could be higher. Emissions of noise in the frequency range of the tuned circuit, of which the coils are an integral part, would be readily picked up by the sensing coils. If the magnitude of the noise is significant relative to the magnitude of the magnetic pulses, the noise-induced errors may be significant.

Using a model HA-S-2200-14 PAD from Frederick Energy Products, LLC of Huntsville, Ala., and a piezoelectric sounder model AI-1223-TWT-SVR from Projects Unlimited, Inc. of Dayton Ohio, experimentation has shown that this problem is detected when the sounder is within about six inches of the coils and produces false alarms when within about four inches from the coils. If integrated PADs were made large enough to allow more than four inches, and preferably more than six inches, separation between the sounder and the coils, the PADs would be too large to be conveniently carried by the workers. A PAD needs to not be any larger than can be fitted into a shirt pocket or similar pocket on a safety vest. Further, it needs to be light so that the size of the enclosure needs to be as small as possible.

To accomplish these requirements, the sounder should be moved as far away from the coils as possible within the PAD housing. However, this alone is not adequate and other steps are required. Typical box shielding with closed compartment panels and guards, positioned between the sounder and the coils is also not sufficient. These shield approaches can reduce the induced noise slightly but they allow the magnetic fields to extend around them from the sounder to the magnetic sensing coils. Shielding foils make slight improvements but are thin (about one thousandth of an inch) and do not sufficiently capture the magnetic fields. In addition, EMI in the vicinity of the sounder induces current in the leads to the sounder, which current is then carried to parts of the electronics, where the current induces additional EMI emitted onto the coils.

A more substantial approach is required to block electrostatic fields and to capture the magnetic fields being produced by the sounder and being induced on its leads. The solution involves three steps. One step is to position the sounder 112 as far from the coils 162 as the housing size will allow. This is shown in FIG. 3. As a second step, wires, leads, and traces in the vicinity of the sounder 112 should be as short as possible to minimize their picking up the EMI and/or their radiating noise. For example, wires leading to the charging port are routed behind the battery 171 (i.e., with the battery positioned between the wires and the pick-up coils) to help shield any radiation from them resulting from any EMI that does couple into them from the sounder 112. These two steps help to avoid noise sources but they are not sufficient. The third step is to provide a metal cup 120, preferably made from mu-metal or copper, into which the sounder 112 is placed. Alloy 145 machinable copper is a commercially available shielding material that may be used for the cup 120.

Figure 7:
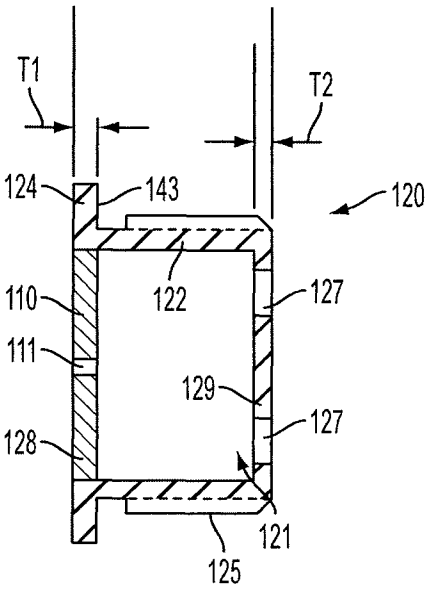
FIG. 7 is a view taken along line VII-VII of FIG. 6.
Figure 6:
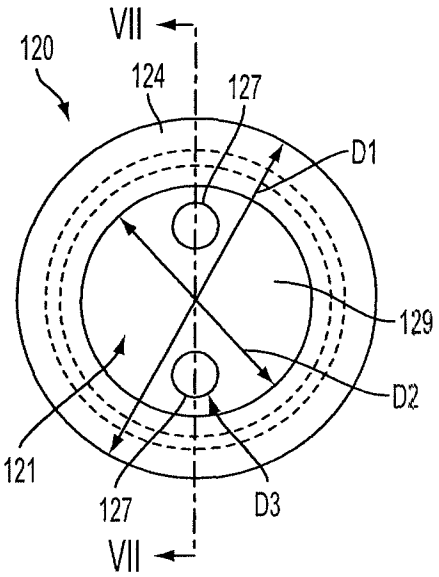
FIG. 6 is an open end view of a sounder shunt cap of an integrated alarm device of FIG. 3.

The cup 120 should cover all of the sounder 112 except the end where the sound exits, as shown in FIG. 6. If the gain of the sensing circuit is higher, the front of the cup 120 can be covered with a plate 110, having only a small hole 111 through which the sound passes, as shown in FIG. 7, and the plate 110 can be soldered to the cup 120. Tiny holes 127, just barely large enough to allow the power leads from the sounder 112 to pass, are fitted near the rear of the sounder housing cup 120 to isolate the leads as much as possible from the emissions from the sounder 112. The power leads should be covered with a thin insulating sleeve to prevent shorting to the cup 120. Very thin heat shrink tubing is suitable for this purpose.

The cup 120 has a cylindrical side wall 122, an outer open end 128 and an inner end wall 129, defining a cylindrical chamber 121. The piezoelectric sounder 112 is housed in the chamber 121, with its power lead wires extending through the holes 127 in the end wall 129. The sounder 112 sound is emitted from the open end 128, or, if the disc 110 is in place, from the disc hole(s) 111. The sounder 112 is not shown in FIGS. 6 and 7. And, the disc 110 is not shown in FIG. 6, rather the empty chamber 121 is shown. The chamber 121 has a diameter D2 at its side wall 122. The inner wall 129 has a thickness T2. The lead wire holes 127 have a diameter D3.

The cup 120 has at its outer end 128, a flange rim 124 extending outwardly from the side wall 122. The rim 124 has and inner diameter D2 (which is the same as the chamber 121 diameter D2), an outer diameter D1 and a thickness T1. Upon threading the cup 120 into the housing 140, the inner surface 143 of the rim 124 engages the outer surface 142 of the housing 140. As such, the rim 124 stands out from the housing by its thickness T1. Having the rim configured in this manner provides collection point surface and structure that shapes the EMI field in a way that enhances capturing or confining it, and decreases the strength of the EMI that leaks from the shielding.

In example embodiments, the thicknesses of the shielding cup 120 and disc 110 are about 0.35 inches to about 0.5 inches. Those thicknesses have been found to be sufficient for attenuating EMI to reduce noise to acceptable levels in the devices tested; the typical shielding foil thickness of 0.001 inch was found to not be sufficient. Generally, as the shielding thickness is decreased, the shielding effect decreases.

The cup 120 is positioned in the housing 140 at a location remote from the antenna pickup coils 162. The cup 120 is oriented so the sound opening (if disc 110 is used the opening is hole 111 and if disc 110 is not used, the opening is defined by diameter D2) and the lead wire openings 127 are not directed towards the antenna pickup coils 162, as can be seen in FIG. 3.

Although all noise may not be completely eliminated, the shielding, sounder and wire orientation and placement should preferably reduce noise in the system caused by the sounder to less than thirty millivolts (30 mV).

Being a safety device, it is important the all parts be positively restrained. Although the sounder 112 can be effectively bonded into the cup 120, given the large surface area relative to the weight of the sounder 112, retaining the cup 120, including the sounder 112, into the PAD plastic housing 140 requires special attention. Bonding the metal cup 120 to the molded plastic housing 140 may not be reliable. A positive restraint is accomplished by machining threads 125 on the outside of the cup 120 as shown in FIG. 7.

The same systems that provide protection for pedestrians from moving machines can also provide protection for one machine from being hit by another machine. This is commonly referred to as Collision Avoidance versus Proximity Detection for pedestrians. Alarm devices are also used on machines as part of Collision Avoidance Systems. Since there is a need to keep Collision Avoidance alarm devices as small as possible to avoid reducing the visibility of the operators and to reduce the chance of being hit or damaged, some of the same problems associated with making PADs small also apply to the Vehicle Alarm Devices (VADs). It is necessary to position sounders close to the low frequency sensing coils such that EMI problems exist and must be solved in a similar to the solution for PADs.

In addition to the EMI problem with the sounder, it has been learned that whenever the UHF transmitter is turned on and off, to accomplished the required pulsing, transients are induced into the coils, especially the one nearest to the transmitter antenna. These transients are strong but are very brief, less than one millisecond long and are avoided by ignoring the signals from the sensing coils when the transmitter is turned on and turned off. Placement of field effect transistors across the coils have been used to disable the sensing coils during the turn on and turn off of the transmitter but tend to introduce transients of their own so that ignoring the short duration transients is preferable if the communication protocol will allow.

Another aspect of this design is minimizing confusion for the worker wearing the PAD. It is desirable that whenever an alarm is being given, that there be no other sounds or visuals indications happening concurrently. It is also important for the worker to know that his/her PAD has adequate charge in the battery. Use of a visual indicator for this purpose is preferable over use of an audible indicator. However, it is also desirable to have the visual indicator 180 to only be activated periodically, such as every 15 seconds, in order to conserve power and thereby extend battery life. To satisfy these competing requirements, the micro-controller must not activate the battery ready indication when the PAD is also issuing an alert. Doing both concurrently would be confusing. Thus, a single visual indicator (LED) 180 is energized (blinked) by the micro-controller 170 on a periodic basis, except when there is need for an alert. When alerting, the micro-controller will withhold an indication of battery status. To accomplish these functions, the LED and the sounder are separately energized via field effect transistors that are controlled by the micro-controller. Advantageously, this arrangement helps cut down on noise to the coils by electrically isolating the sounder wires by minimizing the circuitry connected to the sounder wires.

One method of carrying the PAD is by adding a Velcro patch on the safety vest to which the PAD is routinely attached prior to use. It is then easy to remove the PAD in order to place it on a charger when not in use. A pouch is provided so that a variety of restraint methods may be utilized to give added protection to the PAD. A special safety vest is incorporated that includes a pouch having a flap that restrains the PAD while also being configured to not restrict easy viewing of the warning light and to not obstruct the output of the sounder. A special cloth weave in the vest and/or the pouch protects the sounder opening from dust and particles that could damage the PAD or reduce its effectiveness.

Figure 9:
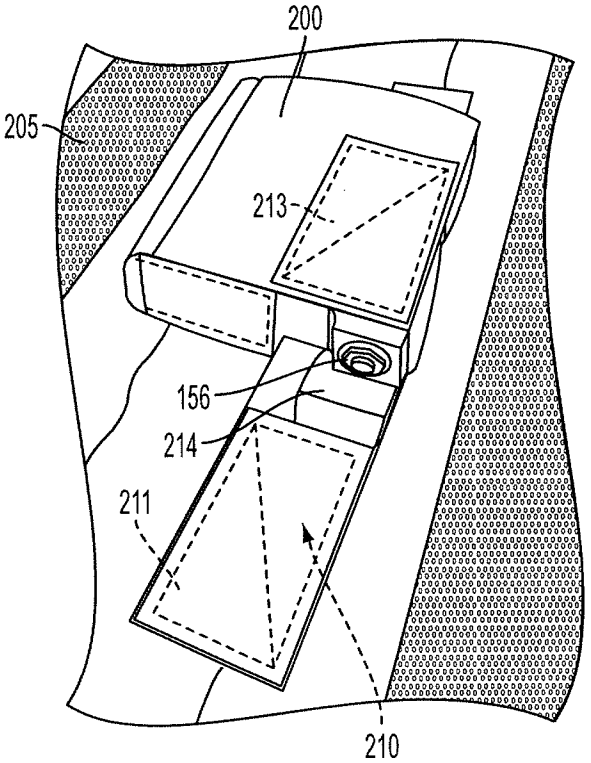
FIGS. 8 and 9 are views of a worker vest pocket for holding an integrated alarm device of FIG. 3.
Figure 8:
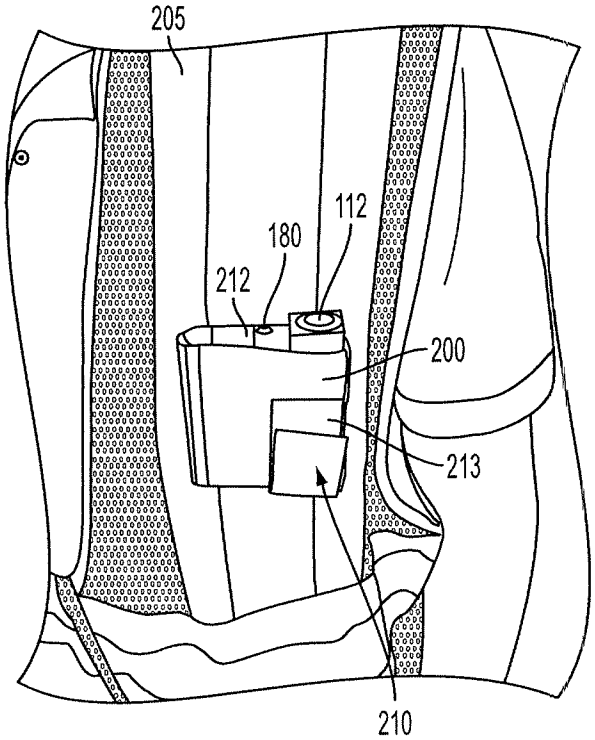

FIGS. 8 and 9 show a PAD being worn in a pouch 200 attached to a safety vest 205. The pouch 200 has two flaps. One of the flaps, the top flap 212 in the illustrated embodiment, closes over the PAD to secure the PAD in the pouch 200 while leaving the LED visual indicator 180 and sounder 112 exposed. The second flap, the bottom flap 210 in the illustrated embodiment, opens to expose the battery charging port 156 and allows the battery charger to be connected without removing the PAD from its pouch 200. FIG. 9 shows the charge port flap 210 in its open position, and shows the charger receptacle 156 exposed for inserting the battery charger plug. When the charge port flap 210 is closed, it is held closed by hook/loop material 211, 213, the charge port sealing foam 214 closes over the charge port 156 and protects the charge port 156 from dust and dirt when the battery 171 is not being charged. After the battery charge is complete and the charge port flap 210 is closed, the PAD is fully operational, ready for use when the safety vest 205 is donned.

Figure 10:
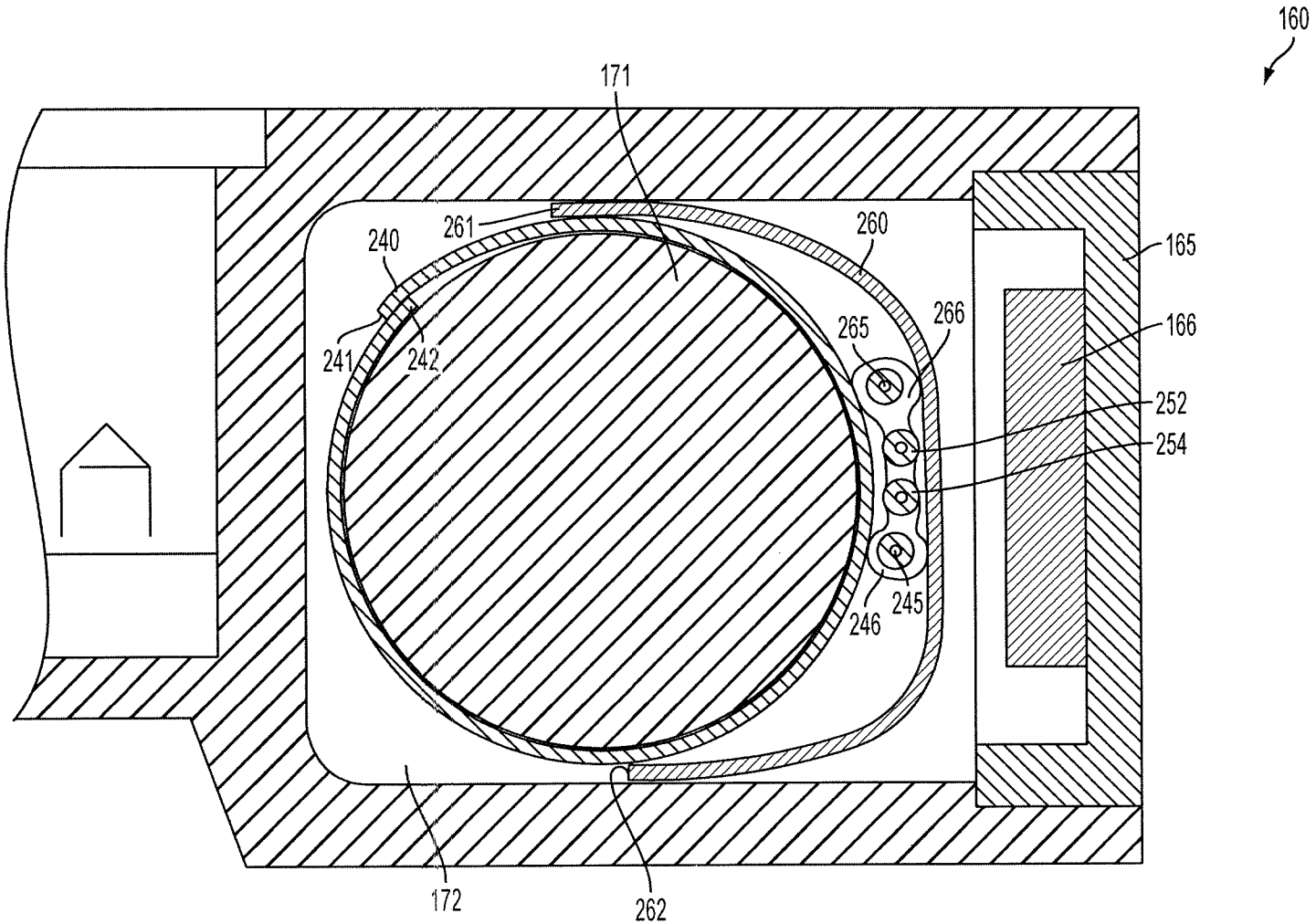
FIG. 10 is a view taken along line X-X of FIG. 3.

Refer now to FIG. 10, additional shielding foil 240, 260 placed in the vicinity of the battery 171 is shown. The foil 240, 260 in an example embodiment is copper and has a thickness chosen to be strong enough to resist damage upon assembly and use, yet thin enough to be pliable for assembly. Three thousandths of an inch thickness of copper has been found to be sufficient in one application, but other thicknesses and materials could be used. A first generally rectangular piece of foil 240 is wrapped around the battery 171 so that the foil edges 241, 242 overlap and the foil is crimped over the battery ends (not shown). A second generally rectangular piece of foil 260 extends from its first edge 260, over the battery 171, around the wires 245, 256, 252, 254 and back under the battery 171 at edge 262 of foil 260. The wires 252 and 254 are the sounder power wires. The wires 246 and 266 are ground wires connected to foils 240 and 260 at solder points 246 and 266 respectively. Both pieces of foil extend over substantially the length of the battery compartment 172 in the direction of axis x. The cap 165 closes the battery compartment. A spacer 166 may positioned on the cap 165 to firmly hold the contents of the compartment 172. The shielding foil 240, 260 impedes electric or magnetic fields (from whatever source) from inducing current in the battery 171 or the wires 245, 256, 252, 254, which may result in undesirable magnetic field generation detectable by the antennae.

The above description and drawings are only illustrative of preferred embodiments, and are not intended to be limiting. Any subject matter or modification thereof which comes within the spirit and scope of the following claims is to be considered part of the present inventions.

What is claimed as new and desired to be protected by Letters Patent of the United States is:

1. An alarm device for a proximity detection system, the proximity detection system having at least one magnetic field generator adapted to generate a magnetic field oscillating at low frequency, the alarm device comprising:

an antenna adapted to sense the strength of a magnetic field in which the device is located;

a sounder device; and a shield adapted to attenuate EMI emitted from the sounder device from reaching the antenna and/or from inducing current in electrical components in the alarm device.

2. The alarm device of claim 1, wherein the sounder device is a piezoelectric sounder device.

3. An alarm device for a proximity detection system, the proximity detection system having at least one magnetic field generator adapted to generate a magnetic field oscillating at low frequency, the alarm device comprising:

an antenna adapted to sense the strength of a magnetic field in which the device is located;

a sounder device; and a shield adapted to attenuate EMI emitted from the sounder device from reaching the antenna and/or from inducing current in electrical components in the alarm device, wherein the shield comprises a metal cup, the metal cup comprising:

a cylindrical side wall, an outer open end, an inner end wall having openings therein to allow wire leads to be attached to the sounder device, and a flange rim extending outwardly from the cylindrical side wall, wherein the cylindrical side wall, the outer open end and the inner end wall define a cylindrical chamber in which the sounder device is housed.

4. The alarm device of claim 3, wherein the metal cup comprises copper.

5. The alarm device of claim 3, wherein the shield further comprises a disc adapted to cover the outer open end of the metal cup, the disc comprising an opening through which sound emitted by the sounder device may pass.

6. The alarm device of claim 3, wherein the metal cup further comprises threading around an outer surface of the cylindrical side wall.

7. The alarm device of claim 3, wherein a thickness of material forming the metal cup is about 0.35 inches to about 0.5 inches.

8. The alarm device of claim 1, wherein the alarm device further comprises an LED adapted to provide a visual warning.

9. The alarm device of claim 1, wherein the sounder device is positioned in a housing of the alarm device at a location remote from the antenna.

10. The alarm device of claim 1, wherein the shield reduces system noise caused by the sounder device to less than about 30 mV.

11. The alarm device of claim 1, wherein the alarm device is configured to fit within a pouch, the pouch comprising a top flap that closes to secure the alarm device within the pouch.

12. The alarm device of claim 11, wherein the pouch comprises a bottom flap that opens to allow for access to a battery charging port of the alarm device.

13. The alarm device of claim 11, wherein the pouch is adapted to attach to a safety vest to be worn by a worker.

14. The alarm device of claim 1, wherein the shield comprises a housing at least partially surrounding the sounder device.

15. The alarm device of claim 14, wherein the housing comprises at least one sidewall.

16. The alarm device of claim 15, wherein the at least one sidewall is a cylindrical sidewall.

17. The alarm device of claim 14, wherein the housing is a sounder housing cup.

18. The alarm device of claim 14, wherein the housing further comprises an outer open end.

19. The alarm device of claim 18, wherein the housing further comprises an inner end wall having openings therein to allow wire leads to be attached to the sounder device.

20. The alarm device of claim 18 further comprising a flange rim extending outwardly from the outer open end.

21. The alarm device of claim 18, further comprising a housing cover adapted to cover the outer open end of the housing, the housing cover comprising an opening through which sound emitted by the sounder device may pass.

22. The alarm device of claim 1, further comprising a battery and first and second foils having edges, wherein the first foil is wrapped around the battery such that edges of the first foil overlap.

23. The alarm device of claim 22, wherein the first foil is crimped over ends of the battery.

24. The alarm device of claim 22, wherein the second foil is wrapped at least partway around the battery such that power wires for the sounder device and ground wires are between the first foil and the second foil.

25. The alarm device of claim 24, wherein each of the first and second rectangular foils extends substantially along a length of a compartment housing the battery.

26. An alarm device for a proximity detection system, the proximity detection system having at least one magnetic field generator adapted to generate a magnetic field oscillating at low frequency, the alarm device comprising:

an antenna adapted to sense the strength of a magnetic field in which the device is located;

a sounder device;

a shield adapted to attenuate EMI emitted from the sounder device from reaching the antenna and/or from inducing current in electrical components in the alarm device; and a battery, wherein the battery is shielded by a first rectangular foil and a second rectangular foil, wherein the first rectangular foil is wrapped around the battery such that edges of the first rectangular foil overlap and the first rectangular foil is crimped over ends of the battery, wherein the second rectangular foil is wrapped at least partway around the battery such that power wires for the sounder device and ground wires are between the first rectangular foil and the second rectangular foil, wherein each of the first and second rectangular foils extends substantially along a length of a compartment housing the battery, and wherein the ground wires are connected to each of the first and second rectangular foils.

27. The alarm device of claim 26, wherein each of the first and second rectangular foils comprises copper foil having a thickness of about 0.003 inches.

28. The alarm device of claim 26, wherein the battery is a rechargeable battery and the alarm device further comprises a battery charging port through which the battery may be recharged.

29. A method for providing proximity detection for detecting the presence of a worker or operator or vehicle carrying an alarm device in a potentially hazardous location at a work site, comprising the steps of:

providing at least one magnetic field generator adapted to generate a magnetic field oscillating at low frequency;

providing at least one alarm device located on the persons of a plurality of workers and/or operators and/or vehicles, the at least one alarm device including an antenna adapted to sense the strength of the magnetic field in which the alarm device is located, a controller electrically coupled to the antenna, and a warning device electrically coupled to the controller, wherein the warning device includes a piezoelectric sounder device and a shield, the shield adapted to attenuate EMI emitted from the sounder device from reaching the antenna and/or from inducing current in electrical components in the alarm device.

30. A method for providing proximity detection for detecting the presence of a worker or operator or vehicle carrying an alarm device in a potentially hazardous location at a work site, comprising the steps of:

providing at least one magnetic field generator adapted to generate a magnetic field oscillating at low frequency;

providing at least one alarm device located on the persons of a plurality of workers and/or operators and/or vehicles, the at least one alarm device including an antenna adapted to sense the strength of the magnetic field in which the alarm device is located, a controller electrically coupled to the antenna, and a warning device electrically coupled to the controller, wherein the warning device includes a piezoelectric sounder device and a shield, the shield adapted to attenuate EMI emitted from the sounder device from reaching the antenna and/or from inducing current in electrical components in the alarm device, wherein the shield comprises a metal cup, the metal cup comprising:

a cylindrical side wall, an outer open end, an inner end wall having openings therein to allow wire leads to be attached to the sounder device, a flange rim extending outwardly from the cylindrical side wall, and a disc adapted to cover the outer open end of the metal cup, the disc comprising an opening through which sound emitted by the sounder device may pass wherein the cylindrical side wall, the outer open end, the inner end wall, and the disc define a cylindrical chamber in which the sounder device is housed.

31. The method of claim 30, wherein the at least one alarm device further comprises a battery, wherein the battery is shielded by a first rectangular foil and a second rectangular foil, wherein the first rectangular foil is wrapped around the battery such that edges of the first rectangular foil overlap and the first rectangular foil is crimped over ends of the battery, wherein the second rectangular foil is wrapped at least partway around the battery such that power wires for the sounder device and ground wires are between the first rectangular foil and the second rectangular foil, wherein each of the first and second rectangular foils extends substantially along a length of a compartment housing the battery, and wherein the ground wires are connected to each of the first and second rectangular foils.

32. The method of claim 31, wherein the metal cup comprises copper having a thickness about 0.35 inches to about 0.5 inches, and wherein each of the first and second rectangular foils comprises copper foil having a thickness of about 0.003 inches.

* * * * *